US006619010B2

(12) United States Patent
Wang Chen

(10) Patent No.: US 6,619,010 B2
(45) Date of Patent: Sep. 16, 2003

(54) SUPER HIGH DOOR STRUCTURE

(75) Inventor: Kuei Yung Wang Chen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 09/985,845

(22) Filed: Nov. 6, 2001

(65) Prior Publication Data

US 2003/0084639 A1 May 8, 2003

(51) Int. Cl.[7] ..... E04C 2/54

(52) U.S. Cl. ..... 52/784.13; 52/784.12; 52/792.1; 52/309.11; 52/456; 49/501; 49/503

(58) Field of Search ..... 52/784.1, 784.12, 52/784.13, 784.14, 784.15, 792.1, 792.11, 794.1, 309.11, 656.4, 656.9, 800.13, 456, 455; 49/501, 503

(56) References Cited

U.S. PATENT DOCUMENTS

| | | | | | |
|---|---|---|---|---|---|
| 678,903 | A | | 7/1901 | Rapp | |
| 2,849,758 | A | | 9/1958 | Plumley et al. | |
| 3,225,505 | A | | 12/1965 | Lytz | |
| 3,546,841 | A | | 12/1970 | Smith et al. | |
| 3,599,703 | A | * | 8/1971 | Mennuto et al. | 160/90 |
| 3,950,894 | A | * | 4/1976 | DiMaio | 52/615 |
| 4,152,876 | A | | 5/1979 | Seely | |
| 4,161,567 | A | * | 7/1979 | Sturgeon | 428/594 |
| 4,550,540 | A | | 11/1985 | Thorn | |
| 4,864,789 | A | | 9/1989 | Thorn | |
| 5,285,608 | A | * | 2/1994 | Costello | 52/456 |
| 5,537,789 | A | | 7/1996 | Minke et al. | |
| 5,634,508 | A | * | 6/1997 | Herbst | 160/371 |
| 5,644,870 | A | * | 7/1997 | Chen | 49/501 |
| 5,722,213 | A | * | 3/1998 | Morency | 52/784.11 |
| 5,727,349 | A | * | 3/1998 | McLaughlin | 49/501 |
| 5,743,057 | A | * | 4/1998 | Martin | 52/457 |
| 5,766,774 | A | * | 6/1998 | Lynch et al. | 428/537.1 |
| 5,887,402 | A | * | 3/1999 | Ruggie et al. | 52/455 |
| 5,934,040 | A | | 8/1999 | Chen | |
| 5,950,382 | A | * | 9/1999 | Martino | 52/311.1 |
| 6,098,368 | A | | 8/2000 | McKann | |
| 6,293,060 | B1 | | 9/2001 | McKann et al. | |
| 6,311,454 | B1 | * | 11/2001 | Kempel | 52/784.15 |
| 6,321,505 | B1 | * | 11/2001 | Packman et al. | 52/784.13 |
| 6,389,769 | B1 | * | 5/2002 | McKinney et al. | 52/309.9 |
| 6,405,506 | B2 | * | 6/2002 | Ruff | 52/656.4 |

* cited by examiner

*Primary Examiner*—Carl D. Friedman
*Assistant Examiner*—Chi Q. Nguyen

(57) ABSTRACT

An assembly structure of a super-high door includes two hubbed door skins and top, bottom, left and right edge-sealing angle bars. The door skins are positioned by flange ribs of the left angle bar. The top and bottom bars are positioned by notches at the top and the bottom ends of the left and right angle bars. The inner side of a first upper longer region (above the handle) of the left angle bar and the inner side of a second lower shorter region (below the handle) of the left angle bar are respectively inlaid with two U-shaped reinforcing irons having a length corresponding to that of the first and second regions. A wood strip with a length shorter than that of the left angle bar is inserted into the inner of the two reinforcing irons and is then closely joined to another wood strip of which the handle position is inlaid with a reinforcing angle bar. The inner side of the right angle bar is inlaid with a reinforcing iron having a length shorter than that of the right angle bar, and a wood strip with a length corresponding to that of the reinforcing iron is inserted thereto and closely joined to another wood strip. After assembly, the structure is filled with ammonium polyester foamed plastic.

8 Claims, 6 Drawing Sheets

SUPER HIGH DOOR STRUCTURE

BACKGROUND OF THE PRESENT INVENTION

1. Field of this Invention

This invention relates to an improvement on the assembly structure of a super-high door by installing multiple reinforcing structures such as the U-shape reinforcing iron and the wood strip to prevent the door from bending and deforming caused by its height too high.

2. Description of Prior Art

Referring to the traditional doors in the market, there are roughly two kinds of door; one is the door with an ordinary height of about 200 cm (6 ft 8 in), the other one is the super-high door with a height of about 240 cm (8 ft). In general the assembly structure of the super-high door is not strong enough to support the weight of itself due to its height too high, which causes bending and deformation to affect its application and safety. Therefore, reinforcing the assembly structure of the super-high door is worthy of the endeavor of the industry to research and develop.

SUMMARY OF THIS INVENTION

The main purpose of this invention is to reinforce the assembly structure of a super-high door to prevent the super-high door from bending and deforming, by inlaying an U-shape reinforcing iron of which the inner is inserted with a wood strip and another wood strip is then closely joined to said wood strip by a nail gun and an adhesive joint, to improve the assembly structure and the firmness of the super-high door.

The other purpose of this invention is to disclose an assembly structure of a super-high door comprising members of two hubbed door skins, a top edge-sealing angle bar, a bottom edge-sealing angle bar, a left edge-sealing angle bar, and a right edge-sealing angle bar. Said hubbed door skin is an integrally molded flush-edged structure which is positioned by the flange ribs of the left edge-sealing angle bar and the right edge-sealing angle bar; meanwhile, the top edge-sealing angle bar and the bottom edge-sealing angle bar are positioned by the milled notches at the top and the bottom ends of the left edge-sealing angle bar and the right edge-sealing angle bar. This invention is characterized in: the inner side of the upper longer region (above the handle) of the left edge-sealing angle bar and the inner side of the lower shorter region (below the handle) of the left edge-sealing angle bar are respectively connected with two U-shape reinforcing irons of which each length is corresponding to each length of said two regions, then a wood strip with a length a little bit shorter than that of the left edge-sealing angle bar is inserted into the inner of the two U-shape reinforcing irons, then by a nail gun and an adhesive joint, another wood strip is closely joined together to the wood strip; besides, the inner side of the right edge-sealing angle bar is connected with an U-shape reinforcing iron of which the length is a little bit shorter than that of the right edge-sealing angle bar, then a wood strip with a length corresponding to that of the U-shape reinforcing iron is inserted thereto and by a nail gun and adhesives joint, another wood strip is closely joined to the wood strip; thereafter, said structure is coated with an adhesive and press-assembled with two hubbed door skins; after assembling, the bottom edge-sealing angle bar is drilled a hole thereof and filled up with ammonium polyester foamed plastic to form a super-high door structure which will not bent nor deform.

BRIEF DESCRIPTION OF THE DRAWING FIGURES

Figure 1:
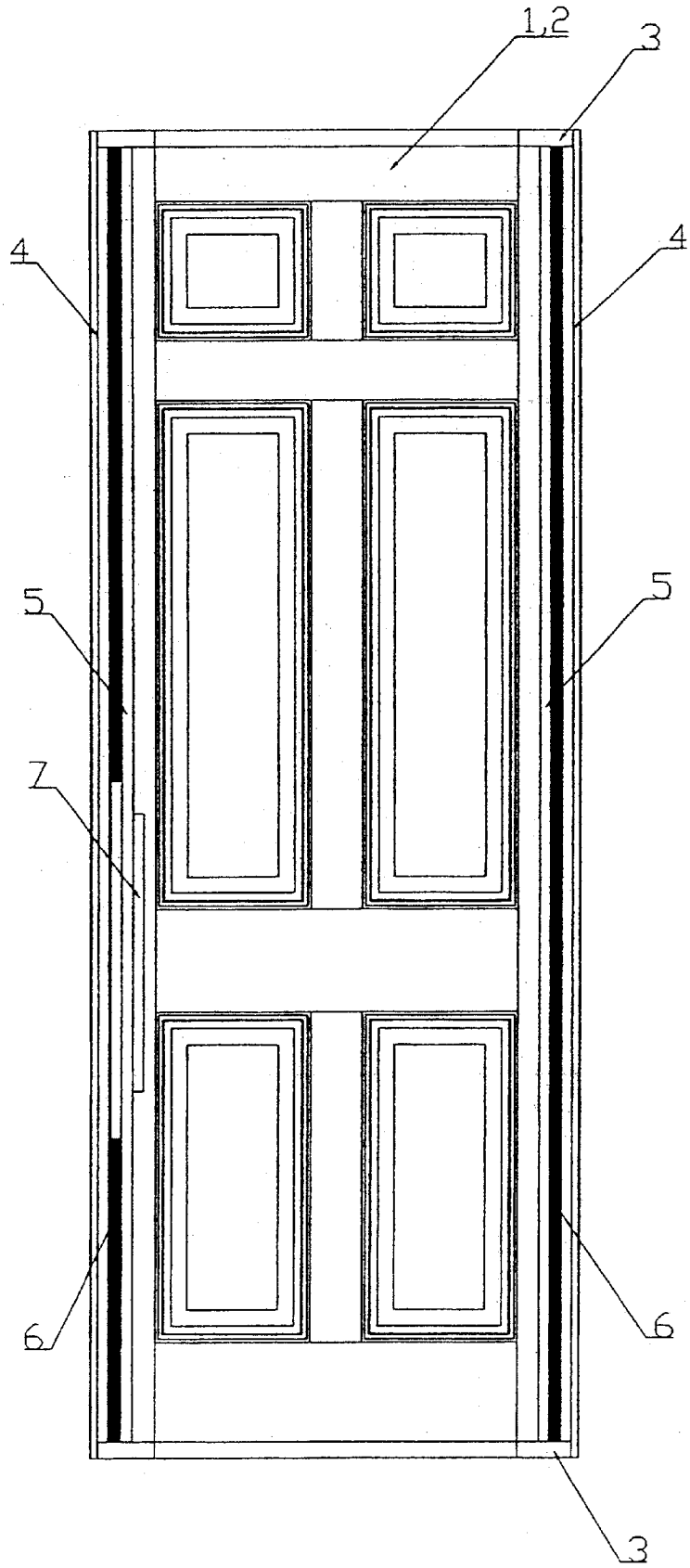
FIG. 1 is an assembly drawing of a door structure.

Symbols of the drawings are explained as follows:

1, 2: skin of hubbed door
1-1: top skin
2-1: bottom skin
3: top and bottom edge-sealing angle bar
3-1: top edge-sealing angle bar
3-2: bottom edge-sealing angle bar
4: left and right edge-sealing angle bar
4-1 left edge-sealing angle bar
4-2: right edge-sealing angle bar
4-3: flange rib of the left and right edge-sealing angle bar
4-4: drilled notch at the top and bottom ends of the left and right edge-sealing angle bar
5: left and right reinforcing angle bar
5-1: wood strip 1 (needed to be edge-drilled)
5-2: wood strip 2
6: left and right U-shape reinforcing iron
6-1: left longer U-shape reinforcing iron
6-2: left shorter U-shape reinforcing iron
6-3: right U-shape reinforcing iron
7: handle area reinforcing angle bar
8: ammonium polyester foamed plastic

DETAILED DESCRIPTION OF THIS INVENTION

Figure 2:
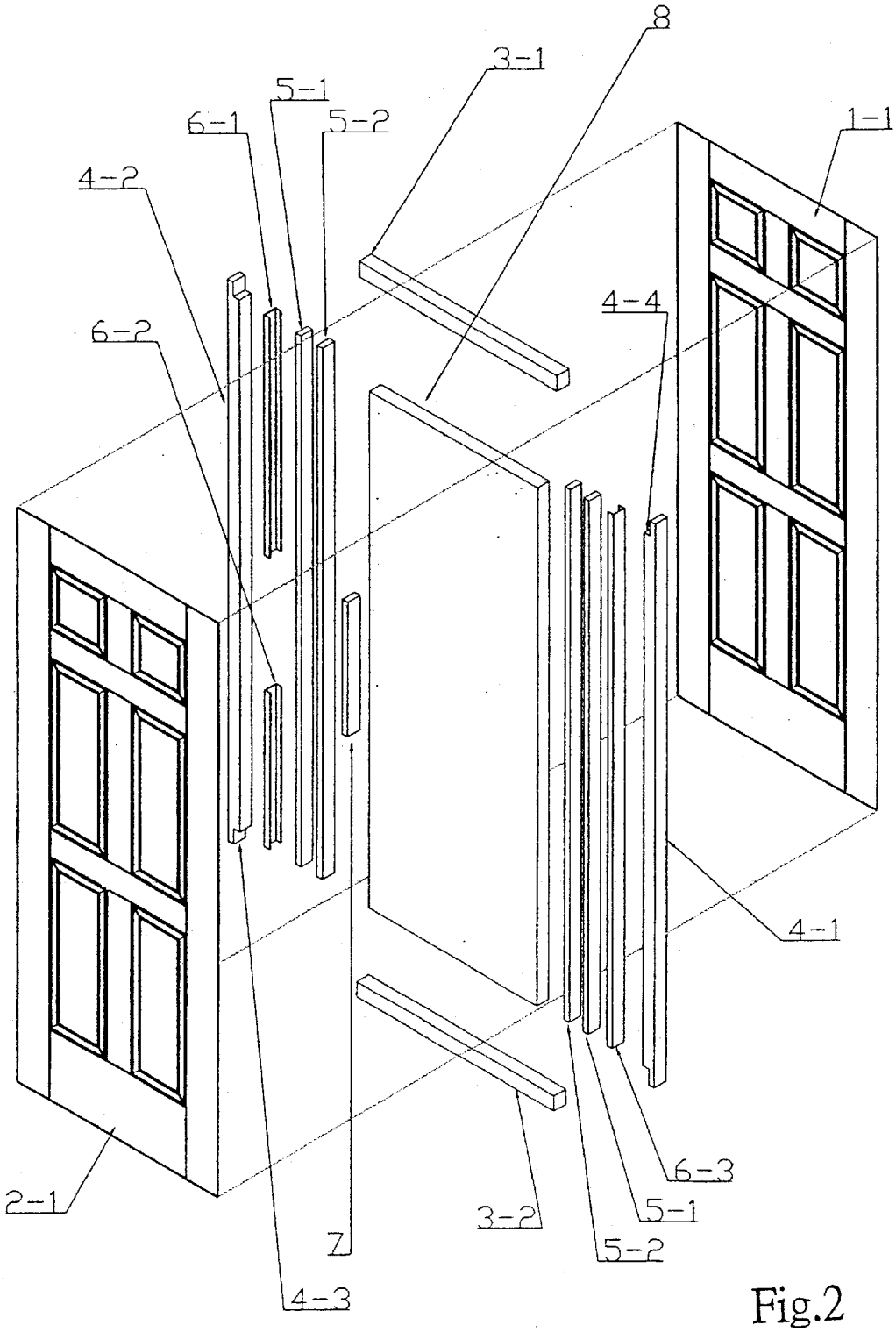
FIG. 2 is an exploded view drawing of a door structure.

This invention improves the assembly structure of the conventional super-high door by installing multiple reinforcing structures such as the U-shape reinforcing iron and the wood strip so as to have the advantage of preventing the door from bending and deforming caused by its height too high. To help be clearly understood, the essence of the skill of this invention in combination of drawings is described in detail as follows:

Referring to FIG. 1 and FIG. 2, the assembly structure of the super-high door of this invention comprises two hubbed door skins 1 or 2, a top edge-sealing angle bar 3-1, a bottom edge-sealing angle bar 3-2, a left edge-sealing angle bar 4-2, a right edge-sealing angle bar 4-1, a couple of left and right wood strips 5-1, another couple of left and right wood strips 5-2, a left longer U-shape reinforcing iron 6-1, a left shorter U-shape reinforcing iron 6-2, a right U-shape reinforcing iron 6-3, and a handle area reinforcing angle bar 7.

The thickness of the hubbed door skin 1 or 2 of this invention is about 1~4 mm, of which the material can be strengthened glass fiber, wood fiber, steel, or natural wood. The outer surface of the hubbed door skin is provided with smooth surface or to simulate wood graining. The depth of wood graining simulated is about 0.05~0.2 mm. The hubbed door skins 1 or 2 can be a flat surface or is embellished as 3 panels door, 4 panels door, or 6 panels door. The opposite side of the hubbed door skins 1 or 2 is then provided with rough surfaces to increase the abrasiveness while adhere-joined. The four edges of the hubbed door skins 1 or 2 are designed to be flush-edged to be closely adhere-joined to and assembled with the top edge-sealing angle bar 3-1, the bottom edge-sealing angle bar 3-2, the left edge-sealing angle bar 4-2, and the right edge-sealing angle bar 4-1. The material of said top edge-sealing angle bar 3-1 and bottom edge-sealing angle bar 3-2 can be PVC foam profile, wood, steel, or ejected plastic.

Figure 3:
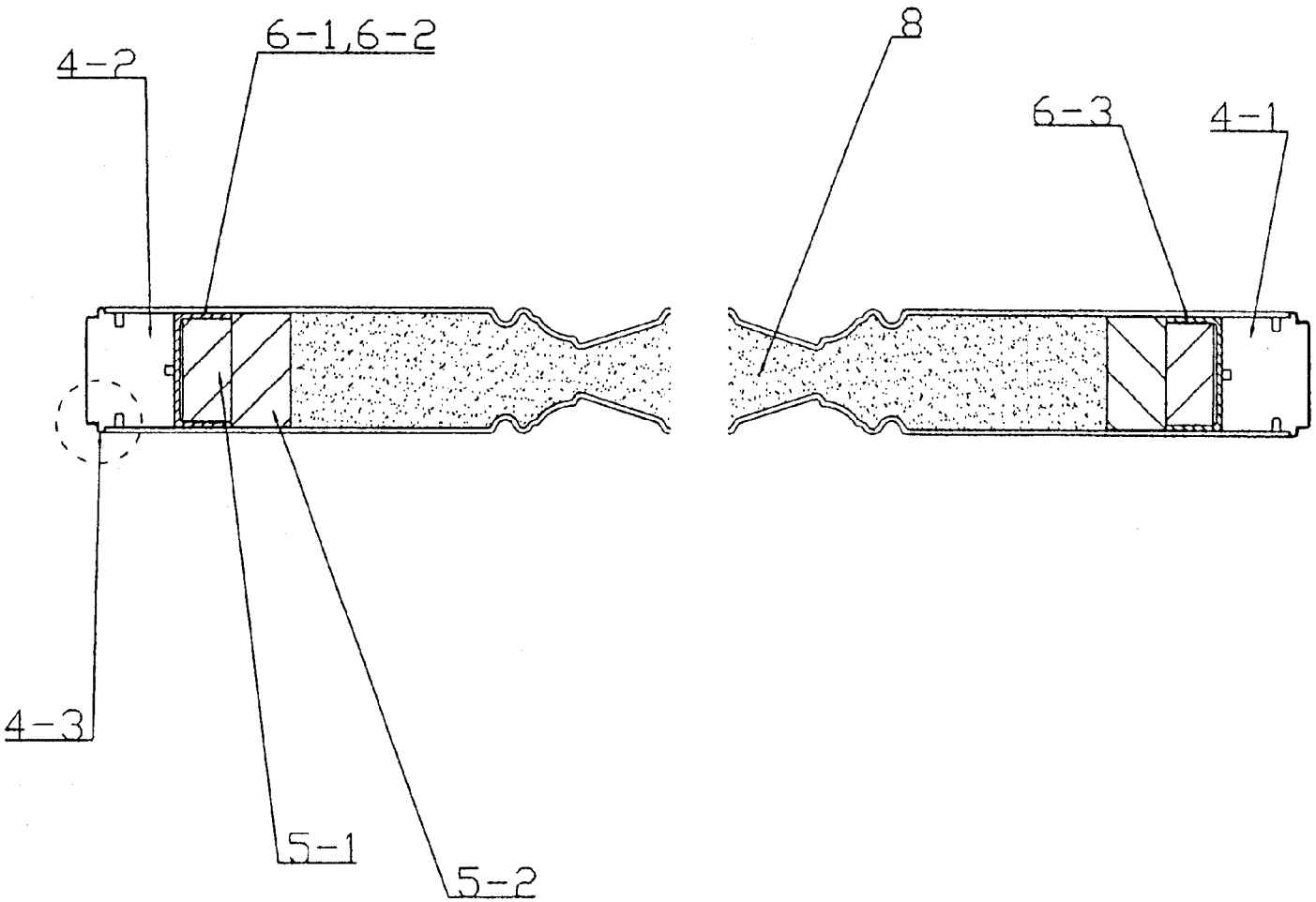
FIG. 3 is a transverse section drawing of a door assembly.
Figure 4:
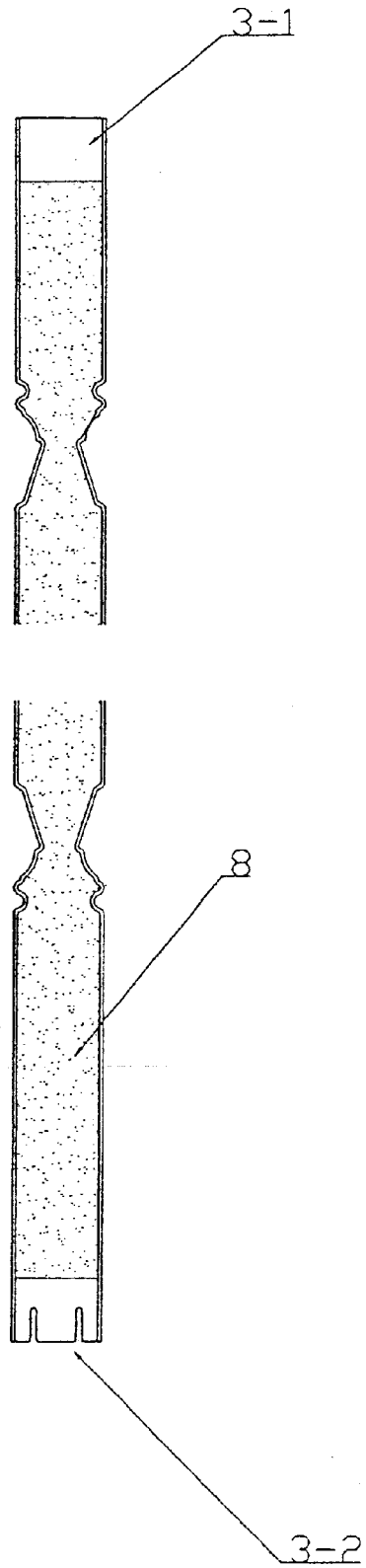
FIG. 4 is a vertical section drawing of a door assembly.

Referring to FIG. 2, the assembling procedure of the super-high door of this invention is as follows: the door skins 1 or 2, the top edge-sealing angle bar 3-1, the bottom edge-sealing angle bar 3-2, the left edge-sealing angle bar 4-2, and the right edge-sealing angle bar 4-1 are closely adhere-joined and assembled. The hubbed door skins 1 or 2 are integrally molded flush-edged structures which are position-joined (referring to FIG. 3 and FIG. 4) by the flange ribs 4-3 of the left edge-sealing angle bar 4-2 and the right edge-sealing angle bar 4-1; meanwhile, the top edge-sealing angle bar 3-1 and the bottom edge-sealing angle bar 3-2 are positioned by the milled notches 4-4 at the top and the bottom ends of the left edge-sealing angle bar 4-2 and the right edge-sealing angle bar 4-1.

Figure 5:
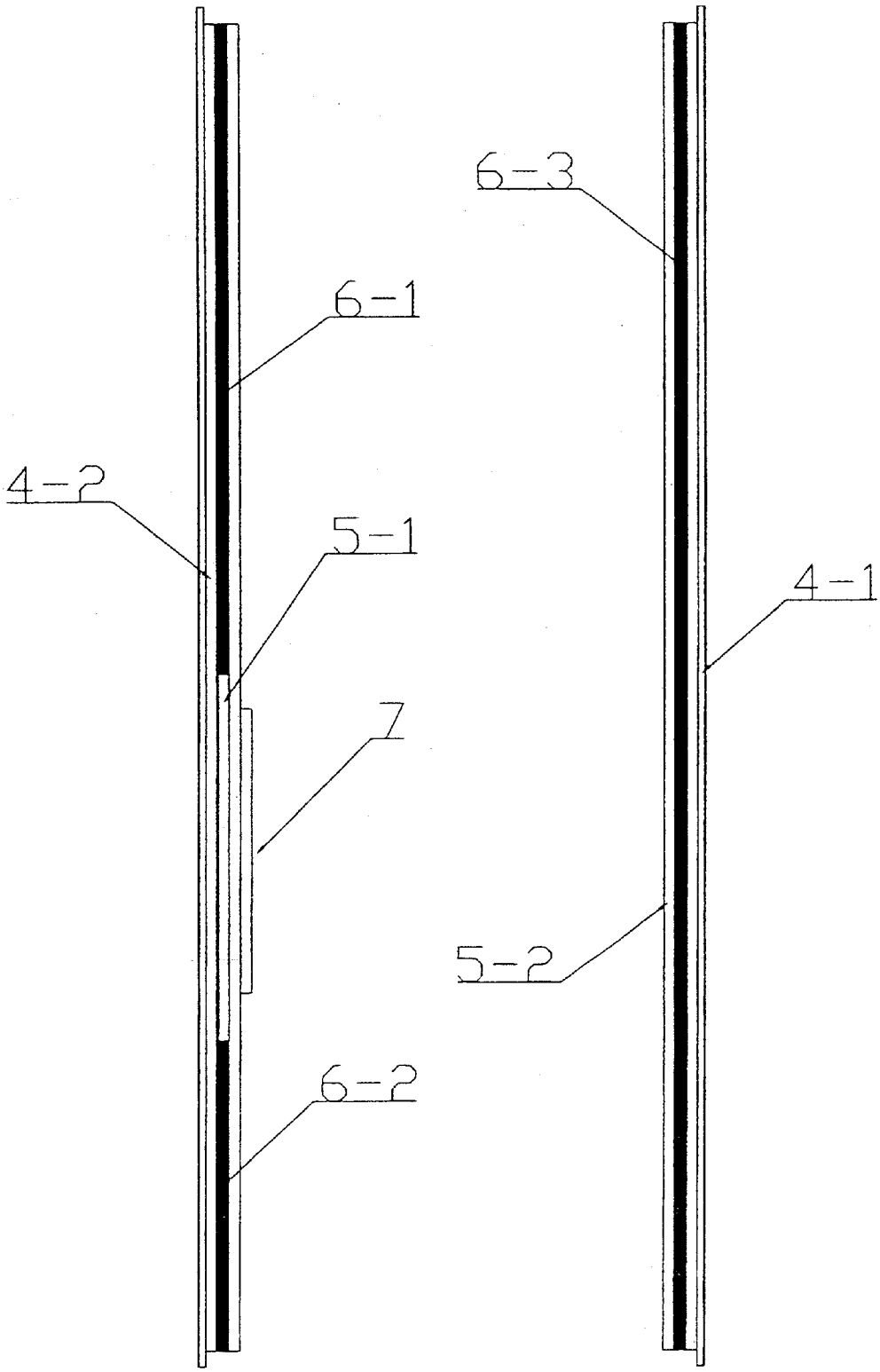
FIG. 5 is a schematic drawing of a reinforced structure.
Figure 6:
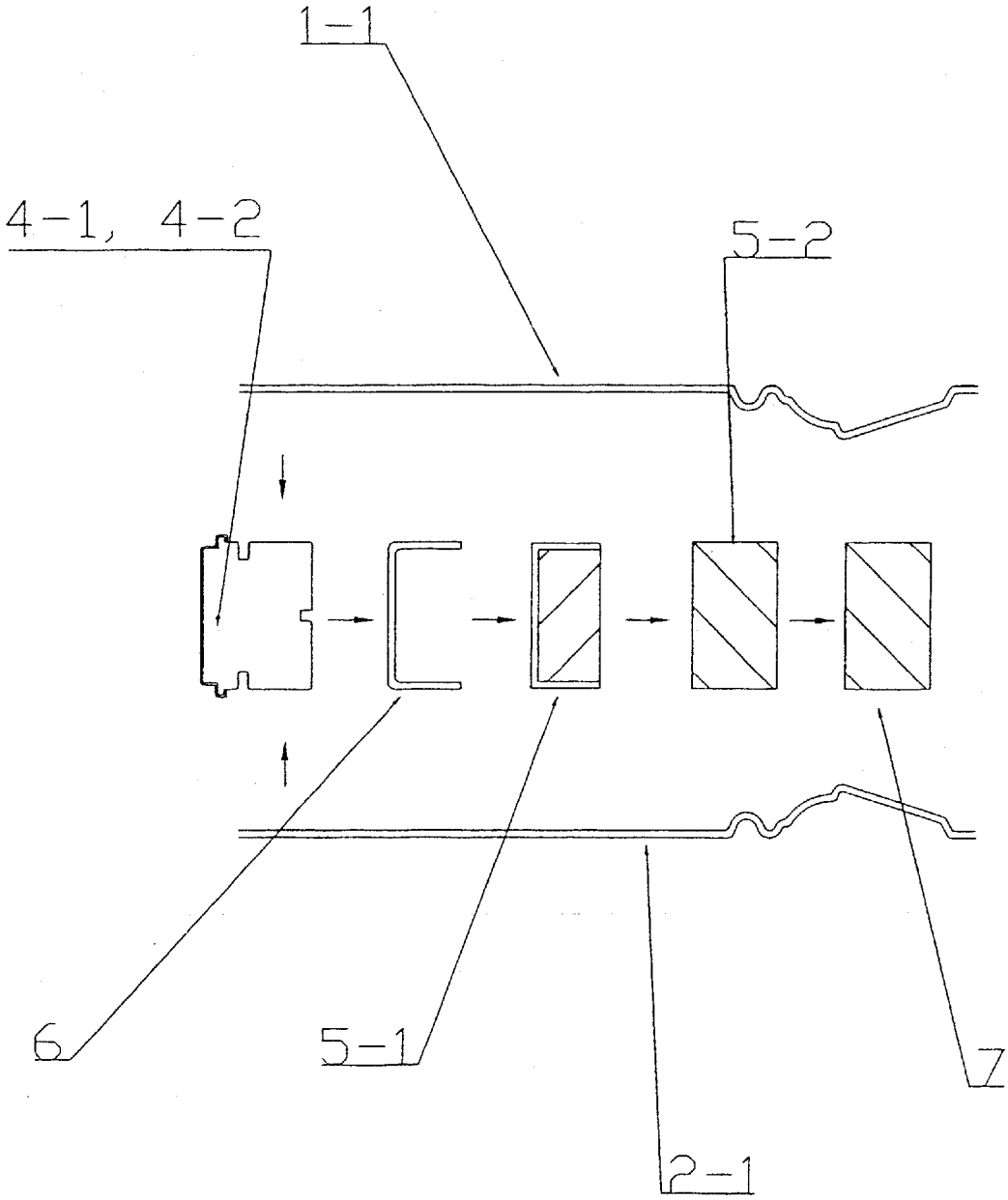
FIG. 6 is a schematic drawing of the assembly procedure of a reinforced structure.

In addition, the inner side of the left edge-sealing angle bar 4-2 and the inner side of the right edge-sealing angle bar 4-1 are inlaid with a reinforcing structure (referring to FIG. 5) of the super-high door of this invention comprising: a couple of the left and the right wood strips 5-1, another couple of the left and the right wood strips 5-2, a left longer U-shape reinforcing iron 6-1, a left shorter U-shape reinforcing iron 6-2, a right U-shape reinforcing iron 6-3, and a handle area reinforcing angle bar 7. After the completion of assembling, the internal of the two hubbed door skins 1 or 2 forms a sealed space; and the bottom edge-sealing angle bar 3-2 is drilled a hole thereof and filled up with ammonium polyester foamed plastic 8 to compose a super-high door.

Referring to FIG. 2, FIG. 3, FIG. 4, FIG. 5, and FIG. 6, to reinforce the strength of super-high door, the preferred embodiment of the super-high door structure of this invention is that the left and the right wood strips 5-1 are capably inlayed into a left longer U-shape reinforcing iron 6-1, a left shorter U-shape reinforcing iron 6-2, and a right U-shape reinforcing iron 6-3 respectively.

Therefore, the super-high door structure of this invention comprises members of two hubbed door skins 1 or 2, a top edge-sealing angle bar 3-1, a bottom edge-sealing angle bar 3-2, a left edge-sealing angle bar 4-2, and a right edge-sealing angle bar 4-1. Said hubbed door skins 1 or 2 are integrally molded flush-edged structure which are positioned by the flange ribs 4-3 of the left edge-sealing angle bar 4-2 and the right edge-sealing angle bar 4-1; meanwhile, the top edge-sealing angle bar 3-1 and the bottom edge-sealing angle bar 3-2 are positioned by the milled notches 4-4 at the top and the bottom ends of the left edge-sealing angle bar 4-2 and the right edge-sealing angle bar 4-1. In addition, the inner side of the upper longer region (above the handle) of the left edge-sealing angle bar 4-2 and the inner side of the lower shorter region (below the handle) of the left edge-sealing angle bar 4-2 are respectively connected with a left longer, U-shape reinforcing iron 6-1 and a left shorter U-shape reinforcing iron 6-2 of which each length is corresponding to each length of said two regions; then a wood strip 5-1 with a length a little bit shorter than that of the left edge-sealing angle bar 4-2 is inserted into the inners of the left longer U-shape reinforcing iron 6-1 and the left shorter U-shape reinforcing iron 6-2. Furthermore, by a nail gun and adhesive joint another wood strip 5-2 is closely joined together onto the wood strip 5-1, and at area of handle to be installed on the wood strip 5-2 another reinforcing angle bar 7 is then jointed to the wood strip 5-2 to reinforce the strength of handle to be installed. Besides, the inner side of the right edge-sealing angle bar 4-1 is connected with an U-shape reinforcing iron 6-3 of which the length is a little bit shorter than that of the right edge-sealing angle bar 4-1, then a wood strip 5-1 with a length corresponding to that of the U-shape reinforcing iron 6-3 is inserted thereto, and by a nail gun and adhesives joint, another wood strip 5-2 is closely joined together to the wood strip 5-1. Thereafter, said structure is coated with an adhesive and press-assembled with two hubbed door skins 1 or 2; after assembling, the bottom edge-sealing angle bar 3-2 is drilled a hole thereof and filled up with ammonium polyester foamed plastic 8 to form a super-high door structure with reinforced strength.

The super-high door of this invention will not bent nor deform by using the assembly of the left longer U-shape reinforcing iron 6-1, the left shorter U-shape reinforcing iron 6-2, the right U-shape reinforcing iron 6-3, and a couple of wood strips 5-1 and 5-2 to compose an unique structure of a reinforced super-high door.

What is claimed is:

1. A super-high door structure, comprising:

two hubbed door skins that are integrally molded flush-edged structures a top edge-sealing angle bar;

a bottom edge-sealing angle bar;

a left edge-sealing angle bar;

a right edge-sealing angle bar;

flange ribs, formed on the left and right edge-sealing angle bars, that position said hubbed door skins on the left and right edge-sealing angle bars, wherein said left and right edge-sealing angle bars include milled notches, formed at top and bottom ends of the left and right edge-sealing angle bars, that position the top and bottom edge-sealing angle bars on the left and right edge-sealing angle bars;

an upper U-shape reinforcing iron, which has a length corresponding to the length of an upper longer region of the left edge-sealing angle bar, that is inlaid with an inner side of the upper longer region;

a lower U-shape reinforcing iron, which has a length corresponding to the length of a lower shorter region of the left edge-sealing angle bar, that is inlaid with an inner side of the lower shorter region;

a first wood strip, having a length a little bit shorter than the length of the left edge-sealing angle bar, that is inserted into inner concave channels of the upper and lower U-shape reinforcing irons;

a second wood strip that is closely joined to the first wood strip;

a reinforcing angle bar that is inlaid with a handle position of the second wood strip;

a right U-shape reinforcing iron, which has a length that is a little bit shorter than the length of the right edge-sealing angle bar, that is inlaid with an inner side of the right edge-sealing angle bare a third wood strip, having a length corresponding to the length of the right U-shape reinforcing iron, that is inserted into an inner concave portion of the right U-shape reinforcing iron;

a fourth wood strip that is closely joined to the third wood strip;

an adhesive that secures the two hubbed door skins to the top edge-sealing angle bar, the bottom edge-sealing angle bar, the left edge-sealing angle bar, and the right edge-sealing angle bar, wherein:

the assembly structure is filled with ammonium polyester foamed plastic to form a super-high door structure that resists bending or deforming.

2. The super-high door structure as defined in claim 1, wherein the material of the hubbed door skin is made of strengthened glass fiber, wood fiber, steel, or natural wood.

3. The super-high door structure as defined in claim 2, wherein the material of the edge-sealing angle bar is made of PVC profile, PVC foam profile, wood, steel, or ejected plastic.

4. The super-high door structure as defined in claim 2, wherein the surface of the hubbed door skin is a smooth surface without vein, or a surface with vein.

5. The super-high door structure as defined in claim 4, wherein the vein depth of the hubbed door skin surface is 0.05~0.2 mm.

6. The super-high door structure as defined in claim 5, wherein the material of the edge-sealing angle bar is made of PVC profile, PVC foam profile, wood, steel, or ejected plastic.

7. The super-high door structure as defined in claim 5, wherein the hubbed door skin is a flat surface or is embellished as 3 panels door, 4 panels door, or 6 panels door.

8. The super-high door structure as defined in claim 7, wherein the material of the edge-sealing angle bar is made of PVC profile, PVC foam profile, wood, steel, or ejected plastic.

* * * * *